US009233271B2

(12) United States Patent
Chen

(10) Patent No.: US 9,233,271 B2
(45) Date of Patent: Jan. 12, 2016

(54) REHABILITATION OR EXERCISING CHAIR DEVICE

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 148 days.

(21) Appl. No.: 14/225,495

(22) Filed: Mar. 26, 2014

(65) Prior Publication Data

US 2015/0273268 A1 Oct. 1, 2015

(51) Int. Cl.

| | |
|---|---|
| ***A63B 21/04*** | (2006.01) |
| ***A63B 21/05*** | (2006.01) |
| ***A63B 26/00*** | (2006.01) |
| ***A63B 21/00*** | (2006.01) |
| ***A63B 23/04*** | (2006.01) |
| ***A63B 21/055*** | (2006.01) |
| ***A47C 9/00*** | (2006.01) |

(52) U.S. Cl.

CPC ..... *A63B 21/1461* (2013.01); *A47C 9/002* (2013.01); *A63B 21/0421* (2013.01); *A63B 21/0428* (2013.01); *A63B 21/055* (2013.01); *A63B 23/0405* (2013.01); *A63B 23/0494* (2013.01)

(58) Field of Classification Search

CPC ..... A63B 21/0081; A63B 21/0083; A63B 21/0085; A63B 21/0087; A63B 21/04; A63B 21/0407; A63B 21/0421; A63B 21/0428; A63B 21/0435; A63B 21/05; A63B 21/055; A63B 21/1465; A63B 21/149; A63B 2021/1609; A63B 23/0405; A63B 23/0494; A47C 9/002; A47C 9/005

See application file for complete search history.

(56) References Cited

U.S. PATENT DOCUMENTS

| | | | | |
|---|---|---|---|---|
| 4,247,098 | A * | 1/1981 | Brentham | 482/112 |
| 4,854,578 | A * | 8/1989 | Fulks | 482/100 |
| 5,020,795 | A * | 6/1991 | Airy et al. | 482/5 |
| 5,080,353 | A | 1/1992 | Tench | |
| 5,209,223 | A | 5/1993 | McGorry et al. | |
| 6,117,056 | A | 9/2000 | Cataldi, Jr. et al. | |
| 7,276,018 | B2 | 10/2007 | Studdard | |
| 2007/0254787 | A1 * | 11/2007 | Matsubara et al. | 482/139 |
| 2007/0298948 | A1 * | 12/2007 | Chen | 482/144 |

* cited by examiner

*Primary Examiner* — Oren Ginsberg
(74) *Attorney, Agent, or Firm* — Charles E. Baxley

(57) ABSTRACT

An exercising chair device includes a chair member having a seat element and an upwardly extended column, a lever pivotally attached to the column and having a bar for engaging with an ankle portion of the user, and a barrel rotatably attached to the lever and rotatable relative to the lever between a lateral working position that is located in front of the bar, and an upwardly extended folding position that is moved away from the bar and located in front of the lever, and for allowing the user to easily engage his feet onto the bar when the barrel is moved away from the bar, and for allowing the feet of the user to be engaged between the bar and the barrel when the barrel is rotated relative to the lever to the lateral working position.

8 Claims, 5 Drawing Sheets

REHABILITATION OR EXERCISING CHAIR DEVICE

BACKGROUND OF THE INVENTION

1. Field of the Invention

The present invention relates to a rehabilitation or exercising chair device, and more particularly to a rehabilitation or exercising chair device including a structure or configuration for the disable persons to easily and safely engage with and actuate or operate the exercising chair device and for comfortably rehabilitate or exercise their legs with the exercising chair device.

2. Description of the Prior Art

Various kinds of typical rehabilitation or exercising devices have been developed and provided for the disable persons to conduct or operate various kinds of exercises, and comprise a large number of the exercising devices for training or exercising the upper muscle groups and/or the lower or other muscle groups of the users.

For example, U.S. Pat. No. 5,080,353 to Tench, U.S. Pat. No. 5,209,223 to McGorry et al., and U.S. Pat. No. 6,117,056 to Cataldi, Jr. et al. disclose several of the typical rehabilitation or exercising devices each comprising a chair member for supporting the user thereon, and an exercising equipment or arrangement or the like disposed or attached or mounted or secured or formed or provided on the chair member for being actuated or operated by the user to train or exercise the upper muscle groups and/or the lower or other muscle groups of the users.

However, the typical rehabilitation or exercising devices comprise a complicated structure or configuration that may not be made or manufactured and may not be used for the disable persons to comfortably rehabilitate or exercise their legs or their lower muscle groups.

U.S. Pat. No. 7,276,018 to Studdard discloses another of the typical rehabilitation or exercising device also comprising a chair member for supporting the user thereon, and an exercising equipment or arrangement or mechanism or the like is disposed or attached or mounted or secured or formed or provided on the chair member for being actuated or operated by the user to train or exercise the upper muscle groups and/or the lower or other muscle groups of the users.

However, the exercising equipment or arrangement or mechanism of the typical rehabilitation or exercising device includes a predetermined or fixed structure or configuration that may not be adjusted or folded to an adjusted structure for allowing the disable persons to easily and safely engage with the exercising chair device and to easily and safely actuate or operate the exercising chair device.

The present invention has arisen to mitigate and/or obviate the afore-described disadvantages of the conventional rehabilitation or exercising devices.

SUMMARY OF THE INVENTION

The primary objective of the present invention is to provide a rehabilitation or exercising chair device including a structure or configuration for the disable persons to easily and safely engage with and actuate or operate the exercising chair device and for comfortably rehabilitate or exercise their legs with the exercising chair device.

The other objective of the present invention is to provide a rehabilitation or exercising chair device including a simplified structure or configuration that may be made or manufactured with a greatly decreased manufacturing cost.

In accordance with one aspect of the invention, there is provided an exercising chair device comprising a chair member including a seat element provided thereon for supporting a user, and including an upwardly extended column located in front of the seat element of the chair member, a lever including an upper portion pivotally attached to the column with a pivot axle for allowing the lever to be pivoted relative to the chair member, and the lever including a bar for engaging with an ankle portion of the user, and a barrel rotatably attached to the lever with a shaft and rotatable relative to the lever between a lateral working position that is located in front of the bar, and an upwardly extended folding position that is moved away from the bar and located in front of the lever, and for allowing the user to easily engage his feet onto the bar when the barrel is moved away from the bar and located in front of the lever, and for allowing the feet of the user to be engaged between the bar and the barrel when the barrel is rotated relative to the lever to the lateral working position that is located in front of the bar, in order to train and exercise the user's legs or his lower muscle groups.

The lever includes a pad engaged onto the bar for comfortably engaging with the feet of the user. The barrel includes a pad engaged onto the barrel for comfortably engaging with the feet of the user. The lever includes an adjustable extension having a tubular member for rotatably receiving and engaging with the shaft of the barrel.

The extension includes a number of orifices formed therein, and a fastener is attached to the lever and engageable with either of the orifices of the extension for selectively and adjustably securing the extension to the lever at the selected positions, such as the lateral working position and the upwardly extended folding position.

The lever includes an anchor attached to the tubular member, and includes two depressions formed in the anchor, and a shank is slidably engaged in the barrel and includes a protrusion extended from the shank and extended out of the barrel for selectively engaging with either of the depressions of the anchor and for positioning the barrel to the tubular member and the lever at selected positions.

The barrel includes an oblong channel or groove formed therein for slidably receiving and engaging with the protrusion of the shank and for guiding and limiting the shank to slide and move relative to the barrel. The shank includes a hand grip provided thereon and extended out of the barrel for being grasped or held by the user and for allowing the user to pull the shank relative to the barrel.

The barrel includes a spring biasing member engaged between the shank and the barrel for biasing the protrusion of the shank to engage with either of the depressions of the anchor. A resistive device may further be provided and coupled between the lever and the chair member for applying a spring biasing force or resistive force to the lever.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
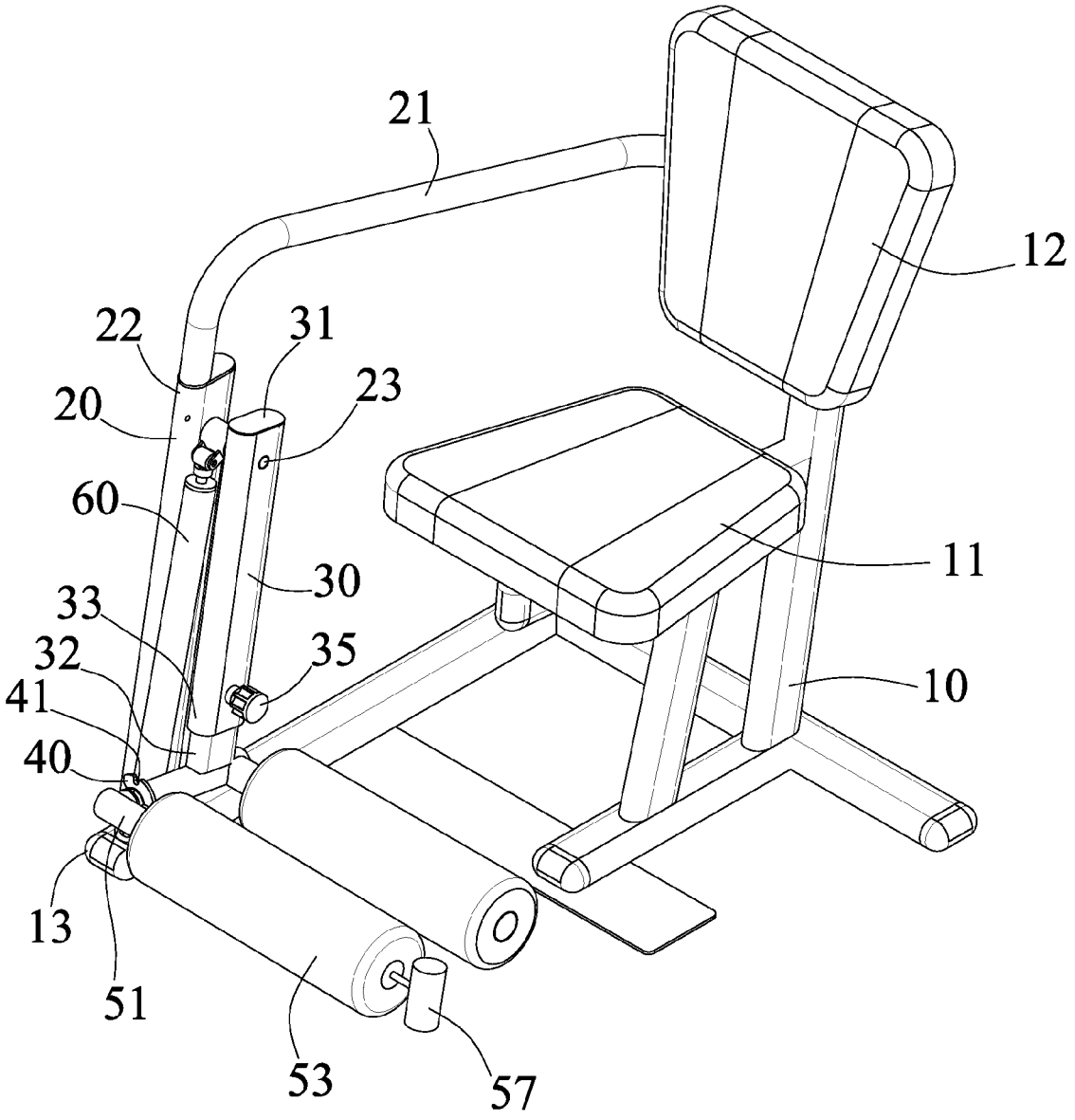
FIG. 1 is a perspective view of a rehabilitation or exercising chair device in accordance with the present invention.
Figure 2:
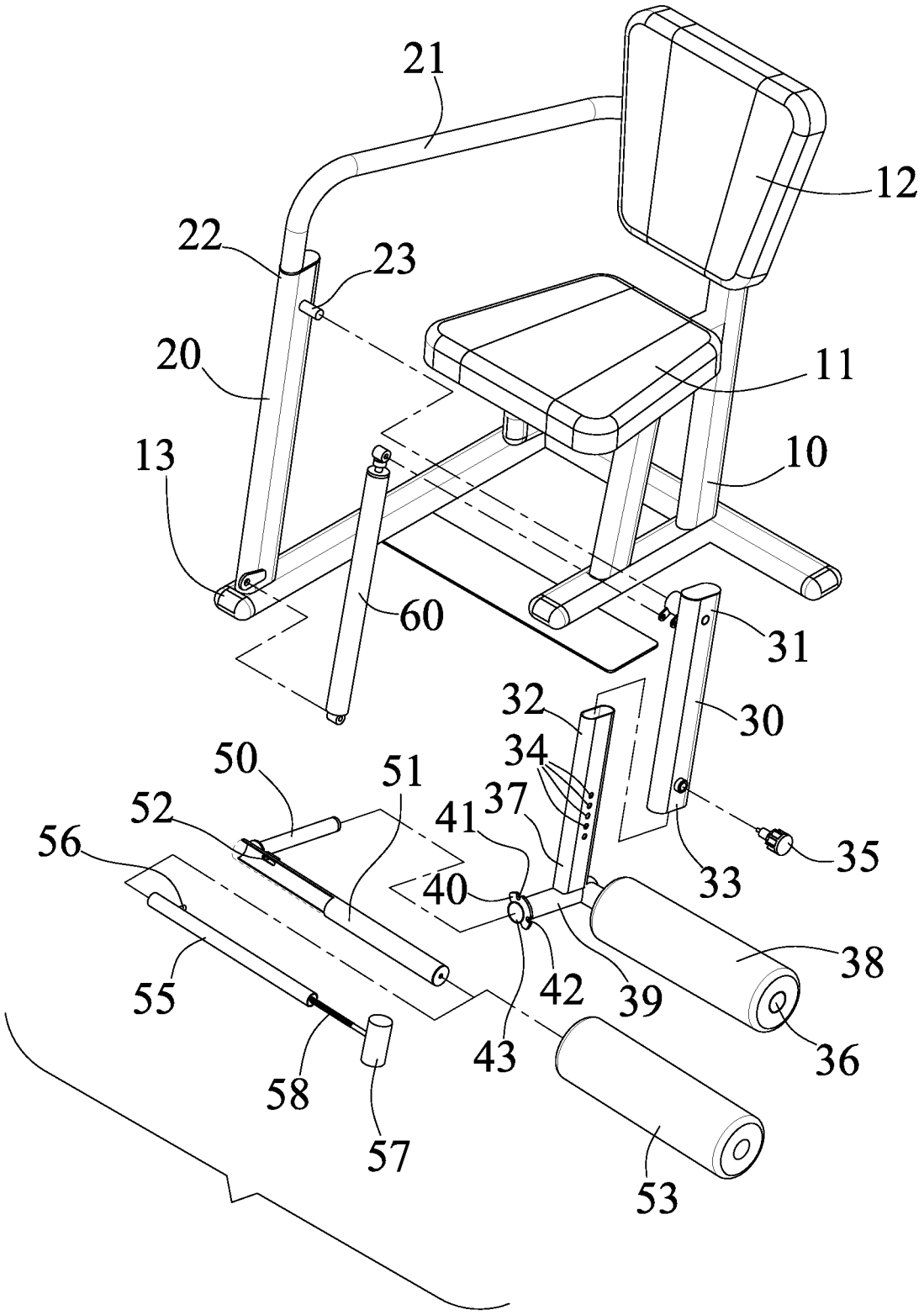
FIG. 2 is a partial exploded view of the rehabilitation or exercising chair device.
Figure 3:
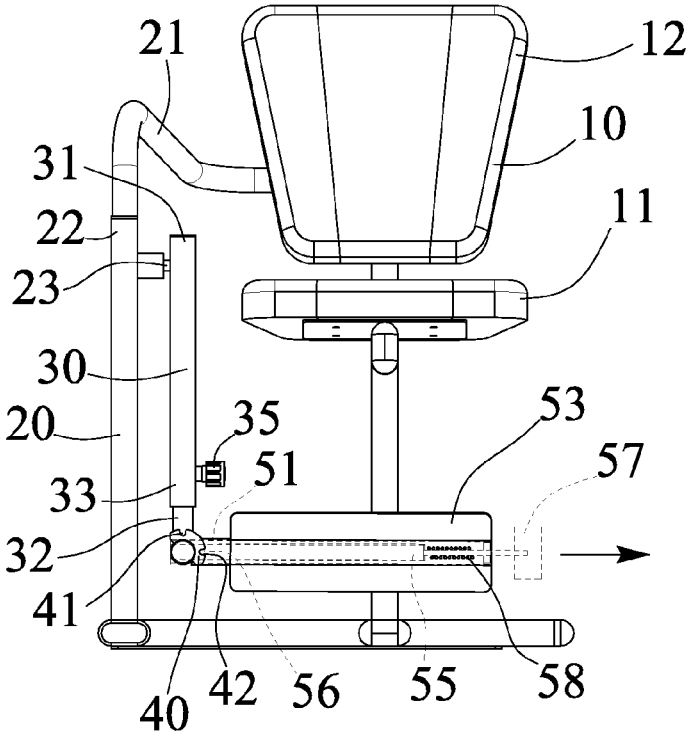
FIG. 3 is a front plan schematic view of the rehabilitation or exercising chair device.

Referring to the drawings, and initially to FIGS. 1-3, a rehabilitation or exercising chair device in accordance with the present invention comprises a chair member 10 including a seat cushion or seat element 11 formed or provided or disposed thereon for supporting the user 8 thereon (FIGS. 5-6), and a seat back 12 disposed or attached or mounted or secured on the chair member 10 for supporting the back portion of the user 8. A post or column 20 is provided and disposed or attached or mounted or secured on the front portion 13 of the chair member 10 and erected or extended upwardly from the chair member 10 and/or located in front of the seat element 11 of the chair member 10, particularly located at one side of the front portion 13 of the chair member 10, and includes a lateral or horizontal arm or beam 21 formed or provided on top of the column 20 and extended rearwardly toward and/or coupled to the seat back 12 or the chair member 10 for reinforcing the column 20 and for acting as an arm rest and for being grasped or gripped or held by the user 8 and/or for supporting the upper portion of the user 8.

A pendulum or bar or handle or lever 30 includes an upper portion 31 pivotally or rotatably attached or mounted or secured to the upper portion 22 of the column 20 with a pivot axle 23 for allowing the lever 30 to be pivoted or rotated forwardly and rearwardly relative to the column 20 and the chair member 10, and includes a sliding member or extension 32 slidably or adjustably attached or mounted or secured to the lower portion 33 of the lever 30 and movable or extendible or slidable or adjustable relative to the lever 30, for example, the extension 32 of the lever 30 includes a number of holes or apertures or orifices 34 formed therein, and a latch or fastener 35 is attached or mounted or secured or engaged with the lower portion 33 of the lever 30 and engaged with either of the orifices 34 of the extension 32 for adjustably attaching or mounting or securing or fastening the extension 32 to the lever 30 at different positions or locations or extensions and for suitably fitting the users 8 of different sizes or dimensions or heights.

Figure 5:
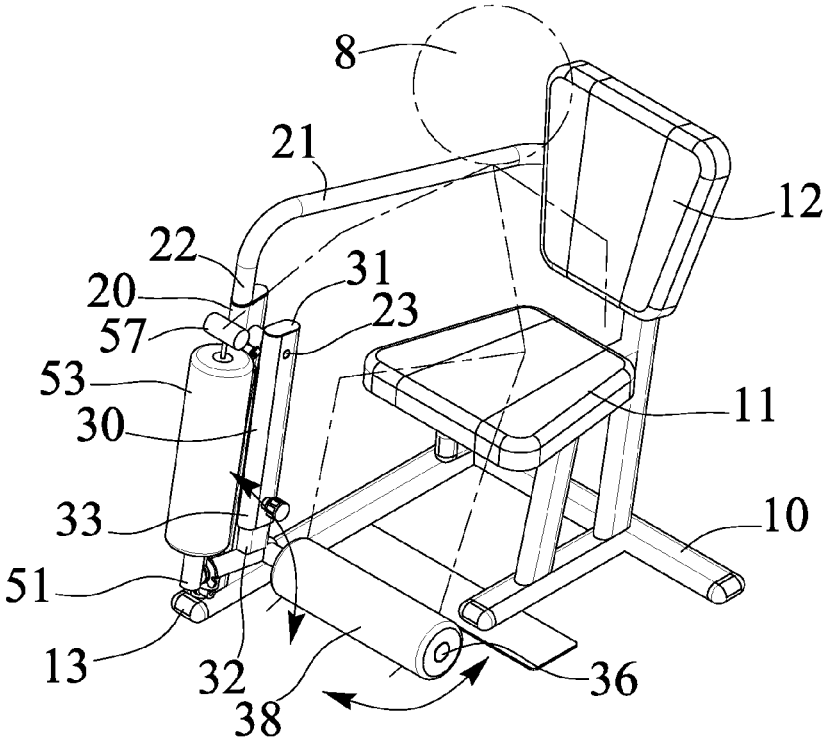
FIGS. 5, 6 are perspective views similar to FIG. 1, illustrating the operation of the rehabilitation or exercising chair device.
Figure 6:
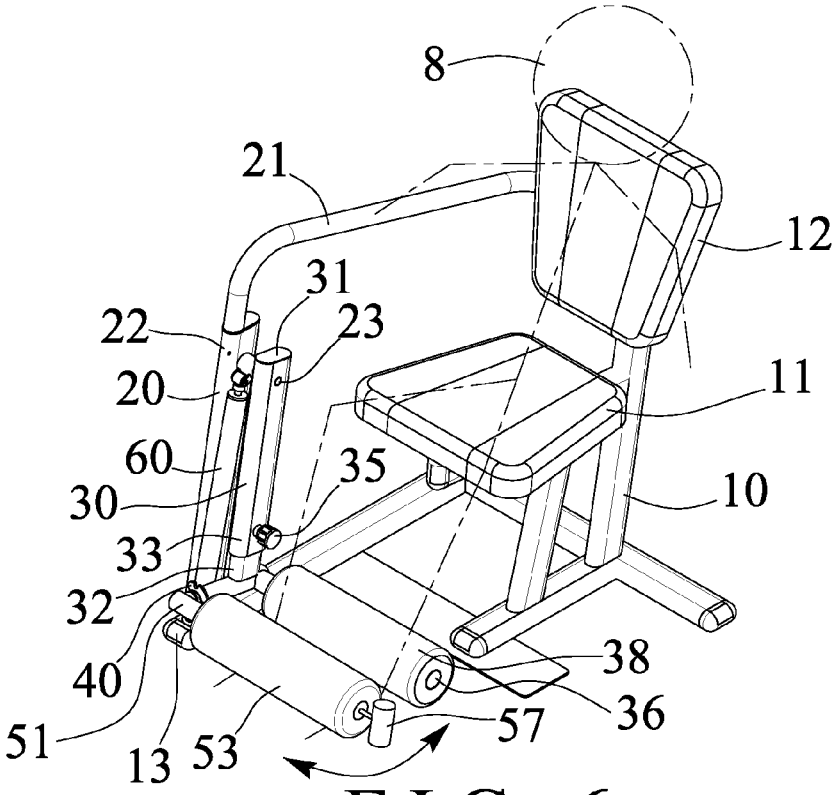
Figure 7:
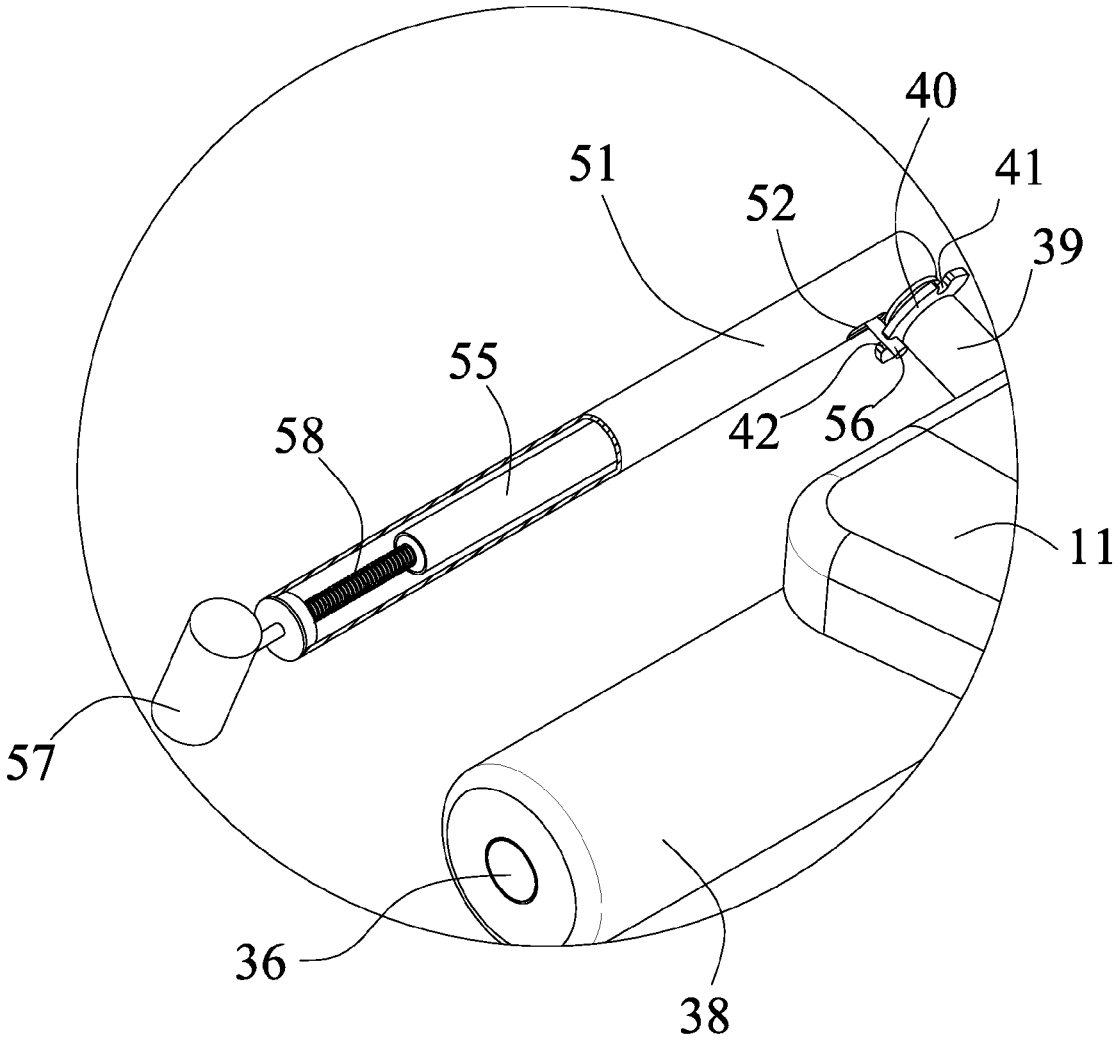
FIG. 7 is an enlarged partial perspective view of the rehabilitation or exercising chair device.

The extension 32 of the lever 30 includes a rod or shaft or anchor or pole or bar 36 attached or mounted or secured to the lower portion 37 of the extension 32 and extended laterally or horizontally and located in front of the seat element 11 of the chair member 10, and a cushion or pad 38 engaged onto the bar 36 for selectively and comfortably engaging with the foot or the ankle portion of the user 8 (FIGS. 5-6). The extension 32 of the lever 30 further includes a pole or bar or shaft or tubular member 39 also attached or mounted or secured to the lower portion 37 of the extension 32 and extended forwardly relative to the extension 32 of the lever 30 and the bar 36, and further includes a flap or panel or anchor 40 attached or mounted or secured to the tubular member 39 and perpendicular to the tubular member 39, and includes one or more (such as two) recesses or notches or depressions 41, 42 formed or provided in the anchor 40 and substantially located around the tubular member 39 (FIG. 2).

As shown in FIG. 2, the tubular member 39 includes a bore 43 formed therein, and another extension or rod or shaft 50 (FIG. 2) is pivotally or rotatably attached or mounted or secured to or engaged into the bore 43 of the tubular member 39 and limited to pivot or rotate relative to the tubular member 39 and the lever 30, and prevented from being moved or slid relative to the tubular member 39 and the lever 30, and another tubular member or cylindrical member or barrel 51 is attached or mounted or secured to or extended from the shaft 50 and perpendicular to the shaft 50, and/or pivotally or rotatably attached to the lever 30 or the extension 32 with the shaft 50, and includes an oblong hole or channel or groove 52 formed therein and arranged or located close to the shaft 50, and another cushion or pad 53 engaged onto the barrel 51 for selectively and comfortably engaging with the foot or the ankle portion of the user 8 (FIG. 6).

A further extension or rod or shaft or shank 55 is slidably received or engaged in the barrel 51, and includes a projection or key or protrusion 56 extended therefrom and slidably received or engaged in the groove 52 of the barrel 51 and extended out of the barrel 51 for selectively engaging with either of the depressions 41, 42 of the anchor 40 and for selectively anchoring or retaining or positioning the barrel 51 and the pad 53 to the tubular member 39 and the lever 30 at different positions or locations, such as at a lateral or horizontal working position that is located in front of the bar 36 and the pad 38 (FIGS. 1, 6), or at an upwardly extended folding or storing position or location that is folded and moved away from the bar 36 and the pad 38 and that is located in front of the extension 32 and the lever 30 (FIG. 5), and the shank 55 includes an extension and/or a hand grip 57 extended out of the barrel 51 for being grasped or gripped or held or pulled by the user 8.

Figure 4:
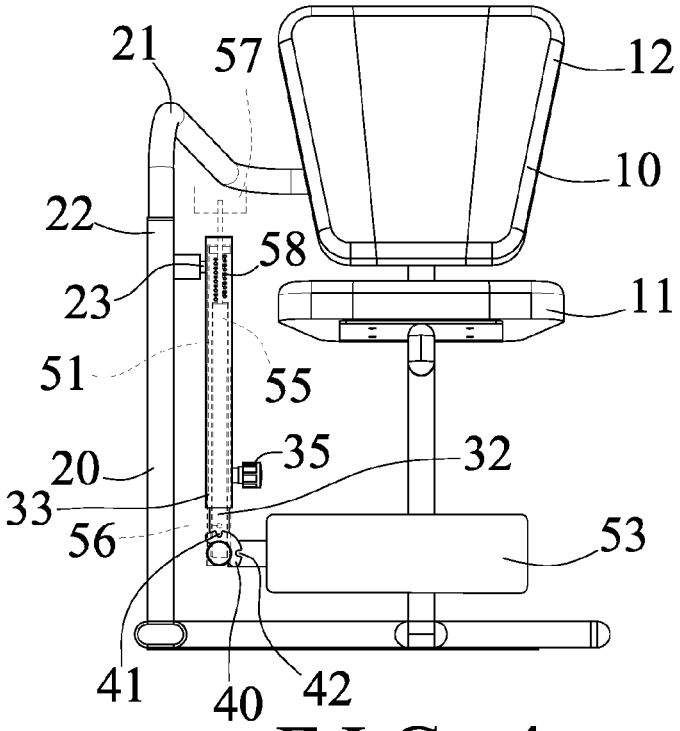
FIG. 4 is another front plan schematic views similar to FIG. 3, illustrating the operation of the rehabilitation or exercising chair device.

A spring biasing member 58 (FIGS. 2, 3) is disposed or attached or mounted or engaged between the shank 55 and the barrel 51 for biasing and forcing or moving the protrusion 56 of the shank 55 to engage with either of the depressions 41, 42 of the anchor 40. In operation, as shown in FIG. 3, the user may hold the hand grip 57 and may pull the hand grip 57 and thus the shank 55 outwardly relative to the barrel 51 against the spring biasing member 58 in order to move or disengage or separate the protrusion 56 of the shank 55 from the anchor 40 and thus for allowing the barrel 51 and the pad 53 to be pivoted or rotated relative to the tubular member 39 and the extension 32 and the lever 30 (FIGS. 4, 5) between the lateral or horizontal working position (FIGS. 1, 6) and the upwardly extended folding or storing position (FIG. 5). The protrusion 56 of the shank 55 may be biased and forced to engage with the depression 41 of the anchor 40 by the spring biasing member 58 after the hand grip 57 is released, in order to anchor or retain or position the barrel 51 and the pad 53 to the tubular member 39 and the lever 30 at the upwardly extended folding or storing position (FIG. 5).

In operation, as also shown in FIG. 5, when the barrel 51 and the pad 53 is pivoted or rotated or folded relative to the bar 36 and the pad 38 and the tubular member 39 and the lever 30 to the upwardly extended folding or storing position, the user, particularly the disable person may easily move his legs to engage onto and to engage with the bar 36 and the pad 38, and the barrel 51 and the pad 53 may then be pivoted or rotated relative to the tubular member 39 and the lever 30 to the lateral or horizontal working position; i.e., in front of the bar 36 and the pad 38, for allowing the feet or legs of the disable person to be easily and quickly engaged between the bar 36 and the pad 38 and the barrel 51 and the pad 53 and may use his feet or legs to pivot or rotate the lever 30 relative to the chair member 10 in order to rehabilitate or train or exercise his lower legs or his lower muscle groups.

As shown in FIGS. 1-2 and 6, another spring biasing member or resilient wire or cable or resistive device 60 may further be provided and attached or mounted or secured or coupled between the lever 30 and the chair member 10 for applying or exerting a spring biasing force to the lever 30 and thus the extension 32 and/or the bar 36 and the pad 38 and the barrel 51 and the pad 53, and for pulling the lever 30 and the extension 32 and the bar 36 and the pad 38 and the barrel 51 and the pad 53 toward the chair member 10 or the user 8, and for resisting the rotational movement of the lever 30 relative to the chair member 10. The chair device includes a simplified structure that may be made or manufactured with a greatly decreased manufacturing cost, and the user 8 may easily and quickly engage his feet or legs between the bar 36 and the pad 38 and the barrel 51 and the pad 53, in order to rehabilitate or train or exercise his lower legs or his lower muscle groups.

Accordingly, the rehabilitation or exercising chair device includes a structure or configuration for the disable persons to easily and safely engage with and actuate or operate the exercising chair device and for comfortably rehabilitate or exercise their legs or lower muscle groups with the exercising chair device, and a simplified structure or configuration that may be made or manufactured with a greatly decreased manufacturing cost.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercising chair device comprising:

a chair member including a seat element provided thereon for supporting a user, and including an upwardly extended column located in front of said seat element of said chair member, a lever including an upper portion pivotally attached to said column with a pivot axle for allowing said lever to be pivoted relative to said chair member, and said lever including a bar for engaging with an ankle portion of the user, and a barrel rotatably attached to said lever with a shaft and rotatable relative to said lever between a lateral working position that is located in front of said bar, and an upwardly extended folding position that is moved away from said bar and located in front of said lever, and for allowing the user to easily engage his feet onto said bar when said barrel is moved away from said bar and located in front of said lever, and for allowing the feet of the user to be engaged between said bar and said barrel when said barrel is rotated relative to said lever to said lateral working position that is located in front of said bar, in order to train and exercise the user's legs, said lever includes an extension having a tubular member for rotatably receiving and engaging with said shaft of said barrel, said lever includes an anchor attached to said tubular member, and includes two depressions formed in said anchor, and a shank is slidably engaged in said barrel and includes a protrusion extended from said shank and extended out of said barrel for selectively engaging with either of said depressions of said anchor and for positioning said barrel to said tubular member and said lever at selected positions.

2. The exercising chair device as claimed in claim 1, wherein said lever includes a pad engaged onto said bar for engaging with the feet of the user.

3. The exercising chair device as claimed in claim 1, wherein said barrel includes a pad engaged onto said barrel for engaging with the feet of the user.

4. The exercising chair device as claimed in claim 1, wherein said extension includes a plurality of orifices formed therein, and a fastener is attached to said lever and engaged with any of said orifices of said extension for adjustably securing said extension to said lever at selected positions.

5. The exercising chair device as claimed in claim 1, wherein said barrel includes a groove formed therein for slidably receiving and engaging with said protrusion of said shank.

6. The exercising chair device as claimed in claim 1, wherein said shank includes a hand grip provided thereon and extended out of said barrel for being held by the user.

7. The exercising chair device as claimed in claim 1, wherein said barrel includes a spring biasing member engaged between said shank and said barrel for biasing said protrusion of said shank to engage with either of said depressions of said anchor.

8. The exercising chair device as claimed in claim 1, wherein a resistive device is coupled between said lever and said chair member for applying a spring biasing force to said lever.

* * * * *